US008072308B2

(12) United States Patent
Aboumrad et al.

(10) Patent No.: US 8,072,308 B2
(45) Date of Patent: Dec. 6, 2011

(54) HIGH VOLTAGE TRANSFORMER AND A NOVEL ARRANGEMENT/METHOD FOR HID AUTOMOTIVE HEADLAMPS

(75) Inventors: Tony Aboumrad, Parma, OH (US); David J Kachmarik, Strongsville, OH (US)

(73) Assignee: General Electric Company, Schenectady, NY (US)

( * ) Notice: Subject to any disclaimer, the term of this patent is extended or adjusted under 35 U.S.C. 154(b) by 990 days.

(21) Appl. No.: 11/710,751

(22) Filed: Feb. 26, 2007

(65) Prior Publication Data

US 2008/0204180 A1 Aug. 28, 2008

(51) Int. Cl.

| | |
|---|---|
| ***H01F 27/28*** | (2006.01) |
| ***H01F 27/02*** | (2006.01) |
| ***H01F 17/06*** | (2006.01) |
| ***H01F 27/24*** | (2006.01) |

(52) U.S. Cl. ..... 336/229; 336/90; 336/92; 336/178; 336/212; 336/225

(58) Field of Classification Search ..... 336/170, 336/178, 212, 225, 229, 90, 92; 445/23
See application file for complete search history.

(56) References Cited

U.S. PATENT DOCUMENTS

| | | | | |
|---|---|---|---|---|
| 3,398,292 | A * | 8/1968 | Kuba | 307/51 |
| 3,611,330 | A * | 10/1971 | Cacossa | 365/140 |
| 3,694,726 | A * | 9/1972 | Cielo et al. | 363/25 |
| 4,298,828 | A * | 11/1981 | Justice et al. | 315/248 |
| 4,451,867 | A * | 5/1984 | Robertson | 361/248 |
| 4,662,343 | A * | 5/1987 | Smith | 123/605 |
| 4,847,986 | A * | 7/1989 | Meinel | 29/606 |
| 5,122,947 | A * | 6/1992 | Hishiki | 363/61 |
| 5,469,334 | A * | 11/1995 | Balakrishnan | 361/782 |
| 5,949,320 | A * | 9/1999 | Cossins et al. | 336/223 |
| 6,031,442 | A * | 2/2000 | Nakazawa | 336/96 |
| 6,040,659 | A * | 3/2000 | Masuda et al. | 315/56 |
| 6,181,081 | B1 * | 1/2001 | Hirschmann et al. | 315/289 |
| 6,462,476 | B1 * | 10/2002 | Hirschmann et al. | 315/58 |
| 6,492,891 | B2 * | 12/2002 | Yamaguchi | 336/198 |
| 6,731,076 | B1 * | 5/2004 | Gerhard et al. | 315/289 |
| 7,009,486 | B1 * | 3/2006 | Goeke et al. | 336/229 |
| 7,042,169 | B2 | 5/2006 | Neumeier et al. | |
| 2003/0222747 | A1 * | 12/2003 | Perkinson et al. | 336/178 |
| 2005/0068143 | A1 * | 3/2005 | Behr et al. | 336/170 |

FOREIGN PATENT DOCUMENTS

| | | | |
|---|---|---|---|
| DE | 197 51 548 | C2 | 6/1999 |
| JP | 11312611 | A * | 11/1999 |

* cited by examiner

*Primary Examiner* — Elvin G Enad
*Assistant Examiner* — Tsz Chan
(74) *Attorney, Agent, or Firm* — Fay Sharpe LLP

(57) ABSTRACT

A high voltage split core transformer and method of assembling same is provided by which the coupling factor is improved. A split core assembly is surrounded by a secondary winding that is precisely located in a burner assembly housing. Conductive members are encased within the housing and, in conjunction with traces provided on a printed circuit board enclosing the housing cavity, define first and second primary windings about the core secondary winding. This arrangement reduces the number of turns in the secondary winding and allows the use of larger cross-sectional wire which increases the current carrying capability thereof, making the transformer suitable for D1-D5 automotive headlamp applications.

19 Claims, 8 Drawing Sheets

HIGH VOLTAGE TRANSFORMER AND A NOVEL ARRANGEMENT/METHOD FOR HID AUTOMOTIVE HEADLAMPS

BACKGROUND OF THE INVENTION

Cross-reference is made to U.S. patent application Ser. No. 11/646,213, filed Dec. 27, 2006, entitled "Lamp Igniter Module and Transformer Carrier"; Ser. No. 11/646,009, filed Dec. 27, 2006, entitled "Lamp Transformer"; Ser. No. 11/645,879, filed Dec. 27, 2006, entitled "Lamp Transformer Assembly"; and Ser. No. 11/513,777, filed Aug. 31, 2006, entitled "Lamp Transformer".

This disclosure relates to an improved high voltage transformer assembly and method of improving the coupling of the high voltage transformer assembly, and a method for enclosing the high voltage transformer within the burner or igniter enclosure in an automotive headlamp application. It will be appreciated, however, that selected aspects may be used in related environments and applications.

Discharge lamp automotive headlamp designs are generally known in the art. For example, U.S. Pat. No. 7,042,169 discloses a gas discharge lamp base where the transformer includes a bar-core or rod-type transformer. Another automotive headlamp design is disclosed in DE 197 51 548, where the ignition transformer includes an electrically non-conductive, Ni—Zn ferrite core, a gap in the core, and a non-conductive solid body disposed in the gap. The solid body protrudes from the body at one side. Yet another automotive headlamp design is shown and described in U.S. Pat. No. 6,181,081. It describes a starting device that includes a transformer with two primary windings connected in parallel and a secondary winding.

A split core arrangement is desirable since it changes the reluctance of the component and the associated BH curve. Thus, as current or flux increases, greater voltage is obtained. Further, the voltage out of the transformer assembly is related to the input voltage multiplied by a function that is related to the number of turns in the secondary winding, and to the number of primary windings as multiplied by a constant.

It is desirable to know the voltage expected from a transformer assembly so that the manufacturer can rely on the expected operation of the headlamp. The coupling factor is dependent on a number of factors, such as geometry, size, shape, number of turns, material, distance, etc. In automotive headlamp designs, there is a limit to the number of turns that is available. By carefully controlling these various factors, coupling is improved. The dimensional constraints of the housing size are dictated by the automotive industry. Likewise, the positioning of the primary winding is important. The positioning must be predictable so that the desired, predetermined voltage out is obtained. Thus, alternative solutions are needed to more closely control the coupling and provide the high voltage necessary for instant startup of headlamps, i.e., on the order of 25 kV.

It is also desirable to provide a transformer assembly design that is adaptable to different headlamps. The headlamps are often referred to or rated as D1-D5 applications, for example, and require different current levels because of the dose and operational characteristics of the lamp. For example, a D1 headlamp incorporates mercury into the fill, needs less steady state current to operate, and usually permits use of lower gage wire for the turns. A D3 lamp, on the other hand, is mercury free and needs greater current. For example, 0.4 amps may be required for a D1 lamp, while 0.8 amps are required for a D3 lamp. Thus, a need exists to provide a transformer design that allows for a reduction in the number of turns in the secondary winding, and yet increases its current carrying capability so that it is suitable for use in D1-D5 applications.

Moreover, simplified manufacturability of the transformer is also desired as well as reduced variation in the coupling factor to improve the performance of the transformer assembly.

BRIEF DESCRIPTION OF THE INVENTION

A high voltage transformer assembly for an associated automotive discharge lamp includes a split core having at least first and second core member portions separated by first and second gaps. A secondary winding is received around at least first regions of each core member portion. First and second primary windings are received about minor portions of the first and second core portions, respectively.

A transformer assembly exhibits improved BH characteristics by including a split core having first and second core members separated by first and second symmetrically spaced gaps. A secondary winding is received over the first and second core members and covers the first gap, while first and second ends of the secondary winding terminate at spaced locations from the second gap. A primary winding is received around at least a portion of the secondary winding. At least a portion of one of the windings is formed by a conductive member in a housing that receives the split core.

A transformer assembly has an improved coupling factor as a result of locating parallel primary windings at a precise position.

A transformer assembly includes a core received within a housing. A secondary winding is received around the core, and a primary winding is received around the secondary winding, formed at least in part by a conductive member received in the housing.

A method of assembling an igniter for an associated automotive discharge lamp having an improved coupling factor includes providing a split core having first and second core portion spaced by symmetrically spaced first and second gaps. A secondary winding extends around the first gap. The first and second ends of the secondary winding are located at positions spaced from the second. The split core with the secondary winding is positioned at a predetermined orientation relative to a housing that receives the split core. The first and second primary windings are provided around the secondary winding such that the first primary winding is placed over the first core portion and the second primary winding is placed over the second core portion.

One advantage of the present disclosure relates to the improved coupling factor.

Another advantage relates to the reduction of the number of turns in the secondary winding.

Still another advantage relates to the increased current carrying capability of the split core transformer.

Yet another benefit is the simplified manufacture of the transformer.

Still another advantageous feature relates to the reduction in the variation of the coupling factor, resulting in improved performance of the transformer.

Still other features and benefits of the disclosure will become more apparent from the following detailed description.

DETAILED DESCRIPTION OF THE INVENTION

Figure 1:
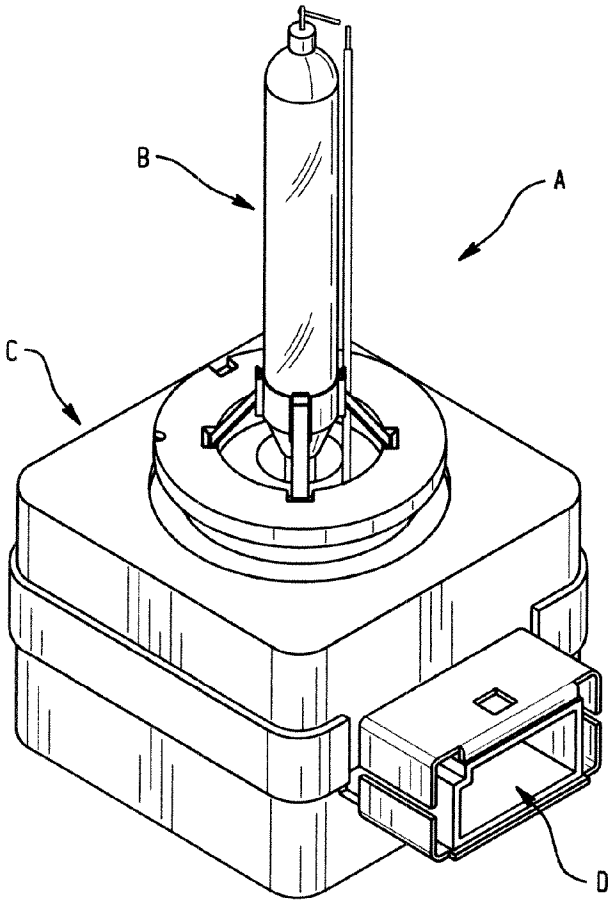
FIG. 1 is a perspective view of an automotive discharge lamp mounted to a burner or igniter assembly.

Turning first to FIG. 1, a lamp assembly such as an automotive headlamp assembly A, is shown. The headlamp assembly A includes a light source B, which in this particular instance is a discharge light source such as an arc discharge of the type commonly used in the automotive industry. The light source B includes a lamp envelope that encloses a pressurized gas fill, which may or may not include mercury. First and second electrodes are spaced within the envelope, typically axially spaced along a longitudinal axis of the elongated lamp envelope. Outer leads protrude outwardly from opposite ends of the envelope for electrical and mechanical connection with a burner assembly C, sometimes referred to as an igniter assembly, that increases or steps up the incoming voltage to an elevated level, for example on the order of 25 kV, for providing an instant start for the discharge lamp. A plug D extends outwardly from the burner assembly C for connection with a mating plug (not shown) extending from a power source associated with the automotive vehicle.

Enclosed within the burner assembly C is a transformer assembly that includes a core 20 (FIG. 2), shown here as a split core, having a first core portion 22 and a second core portion 24. In the preferred arrangement, each core portion 22, 24 is generally C-shaped so that when outer terminal ends are brought into aligned relation, the assembled core portions define a split core of a generally toroidal shape or configuration. Thus, the core includes first and second spaced gaps 26, 28, defined between the first and second core portions. The gaps are preferably filled with an insulating material having an adhesive property that secures the core portions in fixed relation and define precise gap distances. As evident in FIG. 2, the first and second gaps are preferably symmetrically spaced, i.e., disposed at opposite diametrical regions. Although in some instances a greater number of gaps, and likewise a greater number of core portions may be provided, the illustrated embodiment includes two gaps and two core portions. The core is similar to cores commonly used in a transformer and is preferably formed of a material that is capable of withstanding high temperatures and high saturation flux.

A winding, here the secondary winding 30, is received around the core. The secondary winding 30 is, for example, a wire of a predetermined gage that is wrapped around the core and has a predetermined number of turns around the core. Preferably, the turns are evenly spaced about the core and in the illustrated embodiment, the secondary winding extends over the first gap 26, while first and second ends 32, 34 of the secondary winding terminate at locations spaced from the second gap 28. Preferably, the first and second ends 32, 34 are symmetrically spaced from the first gap, and likewise are symmetrically spaced from the second gap. One skilled in the art will appreciate that the split toroid core has a generally rectangular cross-section, defined by parallel, generally planar first (upper) and second (lower) surfaces, and similarly parallel, generally planar third (inner) and fourth (outer) surfaces. Other configurations of the toroid can be used, however, without departing from the scope and intent of the present invention.

Figure 2:
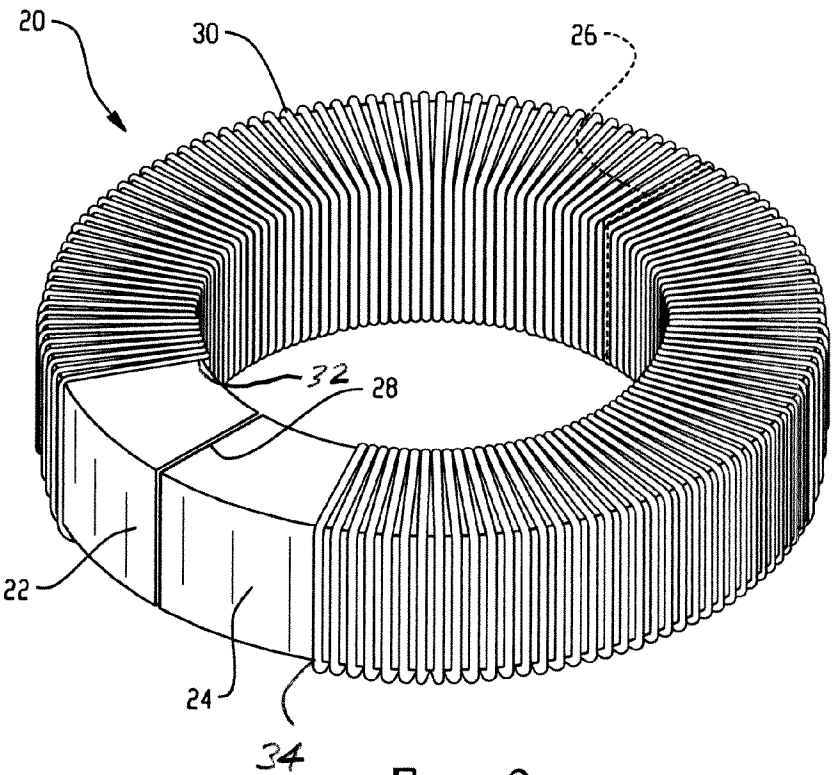
FIG. 2 is a perspective view of a split core assembly with a secondary winding around a core.
Figure 3:
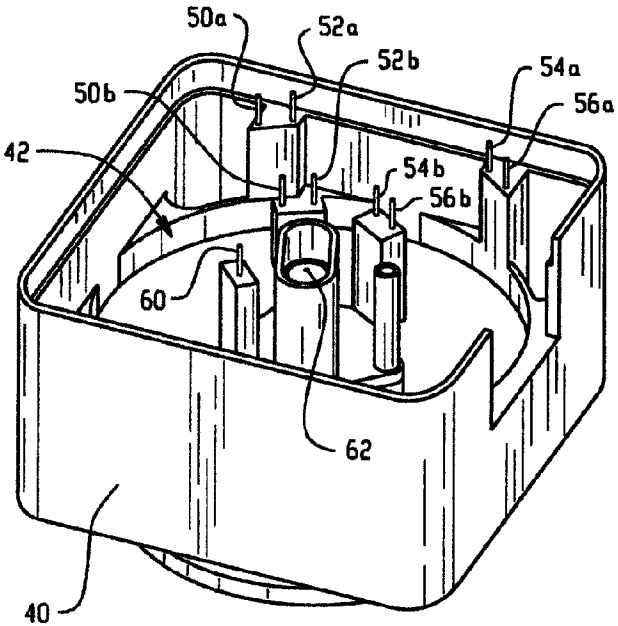
FIG. 3 is a perspective view of an interior cavity of the burner assembly housing viewed from an underside thereof.

FIG. 3 shows an underside of housing 40 that has an internal cavity 42 dimensioned to receive the split toroid and secondary winding shown in FIG. 2. Indicia, such as arrowhead 44, is provided along an internal surface of the housing to provide an alignment feature or orienting function of the split toroid carrying the secondary winding. Particularly, the exposed second gap 28 is preferably aligned with the indicia 44, so that the angular orientation of the split toroid within the housing cavity is precise.

Molding the housing from a resin such as plastic is preferred in order to provide detailed contours of the housing cavity. Incorporated into the plastic housing are conductive members, shown here as four separate conductive members, 50, 52, 54, 56, disposed in pairs of two, such as first pair 50, 52 and second pair 54, 56. Each conductive member is generally U-shaped and substantially an entire length of each conductive member is encased within the housing 40. Opposite, terminal ends of each conductive member designated by suffixes "a", "b", e.g., 50*a*, 50*b*, protrude outwardly in exposed fashion from the housing for reasons which will become more apparent below.

Figure 15:
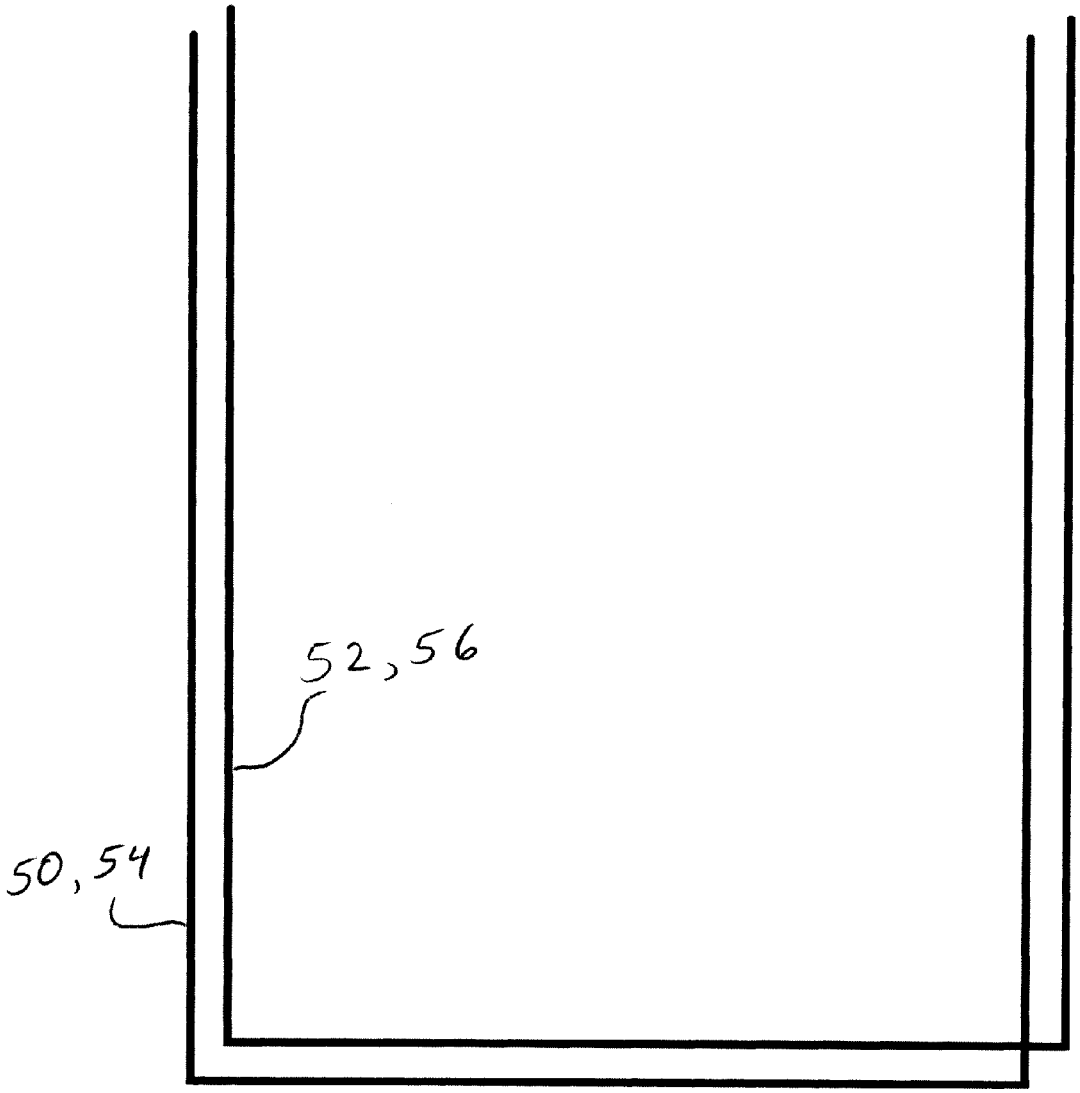
FIG. 15 is a perspective view of a portion of one of the first and second primary windings.

The U-shaped conductive members (See FIG. 15) each have a depth from the outer terminal ends toward the bight portion thereof that is greater than the height (distance between the first, upper surface and the second, lower surface) of the split toroid carrying the secondary winding. Consequently, when the split toroid and secondary winding subassembly of FIG. 2 is placed within the housing cavity (FIGS. 5 and 6), portions of the core and secondary winding sit within the recess defined by each of the U-shaped conductive members. Stated another way, the U-shaped conductive members substantially wrap around three sides of the split toroid and secondary winding subassembly.

Figure 4:
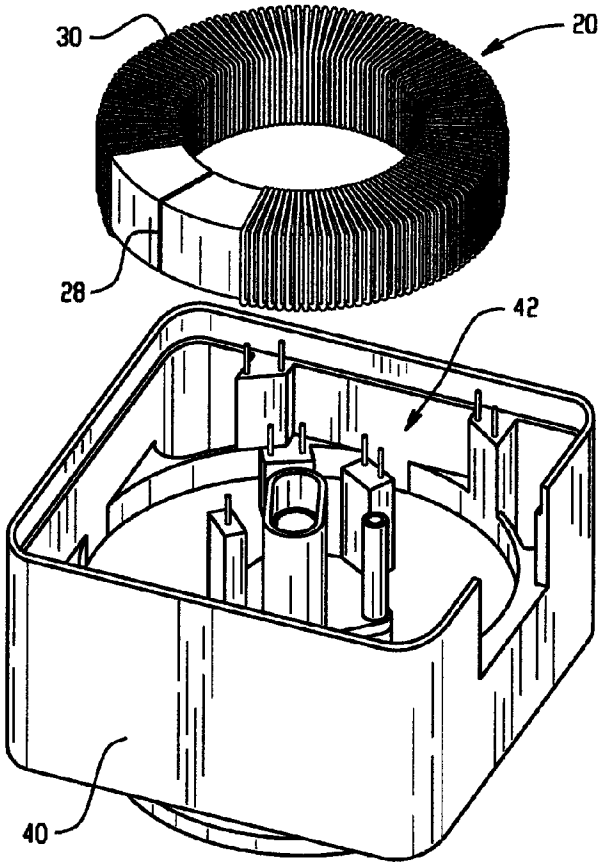
FIG. 4 is a perspective view illustrating insertion of the core member with the secondary winding into the housing.
Figure 5:
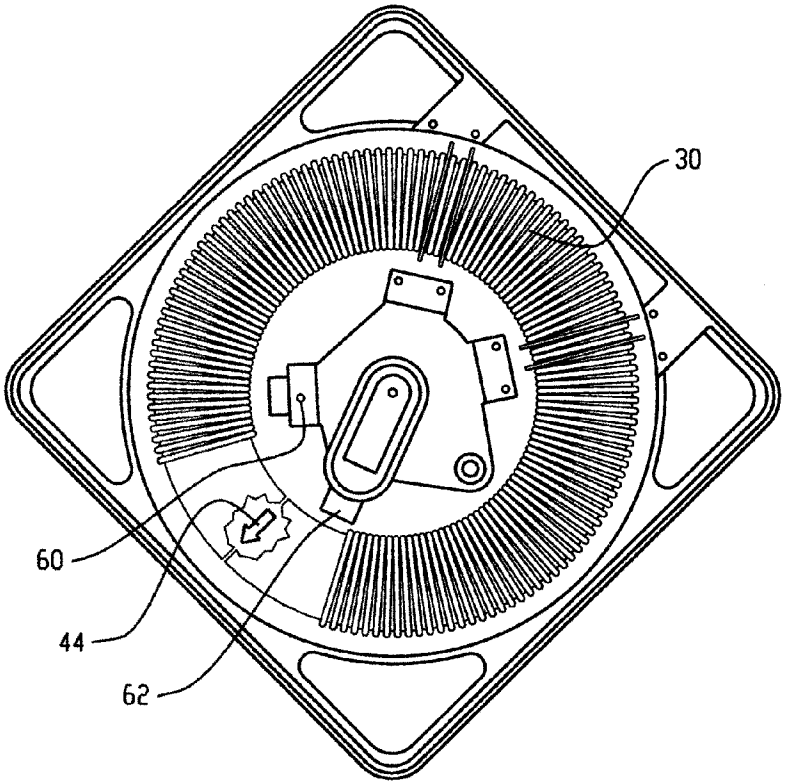
FIG. 5 is a plan view of the precise location of the core and secondary winding within the housing.

Also shown in FIGS. 3-5 are a pin 60 and conductive pad 62 that electrically connect with the first and second ends 32, 34, respectively, of the secondary winding. The conductive pin and conductive pad have a predetermined orientation or location in the housing cavity such that when the split toroid subassembly carrying the secondary winding is oriented with the indicia 44 of the housing cavity, the first and second ends of the secondary winding are located adjacent the respective conductive pin and pad 60, 62. Thus, the opposite ends of the secondary winding are electrically and mechanically connected to the pin and pad, for example, through a welding operation.

Figure 6:
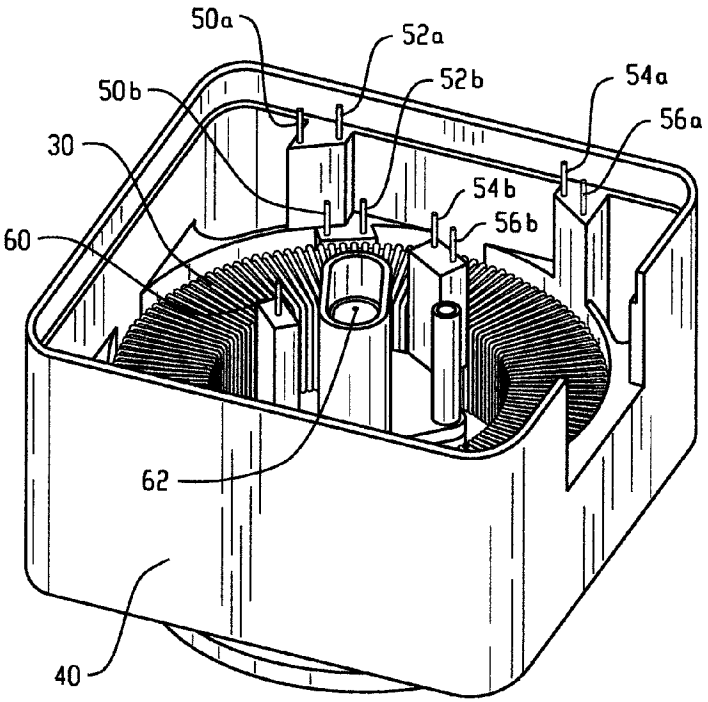
FIG. 6 shows a further step of potting the transformer in the housing.

FIG. 6 is representative of a potting step in the assembly process. That is, once the split toroid subassembly has been properly oriented in the housing cavity and the secondary wire ends welded, the assembly may be potted by introducing an insulative potting material into the housing cavity. The potting material electrically insulates the assembly and also serves as a moisture seal, in addition to further securing the assembly from inadvertent movement within the housing.

Figure 8:
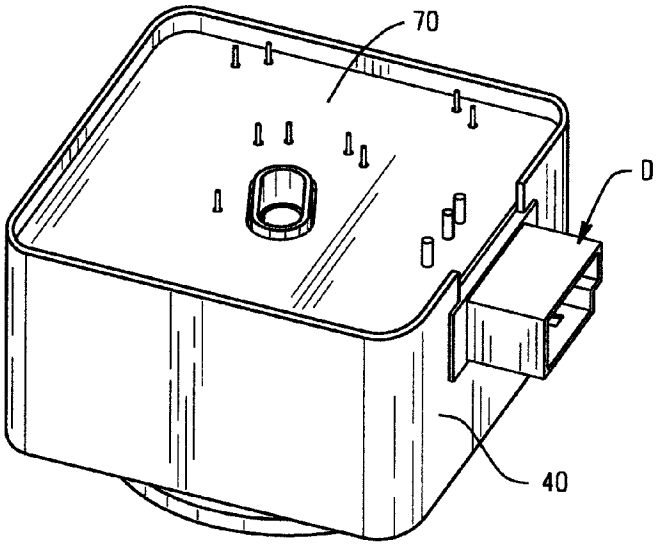
FIG. 8 illustrates the printed circuit board in the installed position with the housing.
Figure 7:
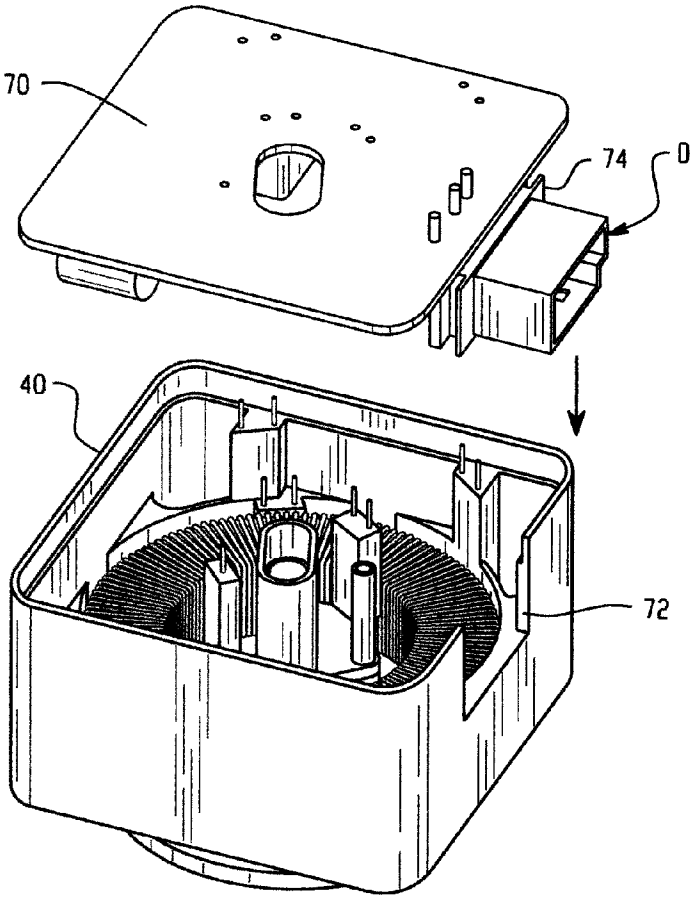
FIG. 7 illustrates placement of a printed circuit board assembly into the cavity from the underside of the housing.

FIGS. 7 and 8 represent the step of installing a preassembled printed circuit board 70 over the open end of the housing cavity. The particular details of the printed circuit board are known to those in the art and comprise electrical components and conductive traces. In this particular instance, traces are provided in the printed circuit board so that ends of the conductive members 50, 52, 54, 56 are mechanically and electrically connected in a desired fashion and as will be described further below. The board 70 is oriented so that plug D is received in a sidewall recess 72 of the housing. Shoulders 74 provided on the plug are located inwardly and outwardly of the housing and provide resistance to push-in or pull-out forces imposed on the plug during the electrical/mechanical makeup of the lamp assembly with the mating plug (not shown). That is, the shoulders are received on inner and outer surfaces of the housing about the perimeter of the recess. Once the printed circuit board is fully installed, as illustrated in FIG. 8, the outer terminal ends of the conductive members 50, 52, 54, 56, as well as conductive pin 60, are shown protruding outwardly from spaced openings in the printed circuit board so that these terminal ends are accessible for further connection such as through a welding operation to be described below.

Figure 10:
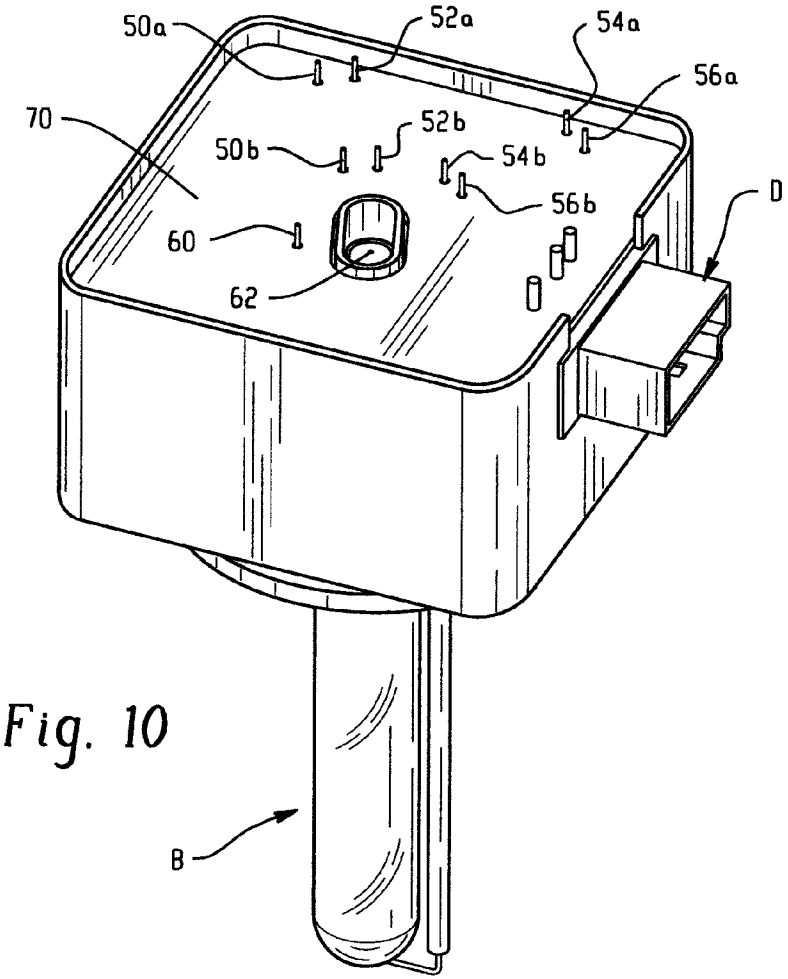
FIG. 10 represents welding of the lamp leads to first and second ends of the secondary winding.
Figure 9:
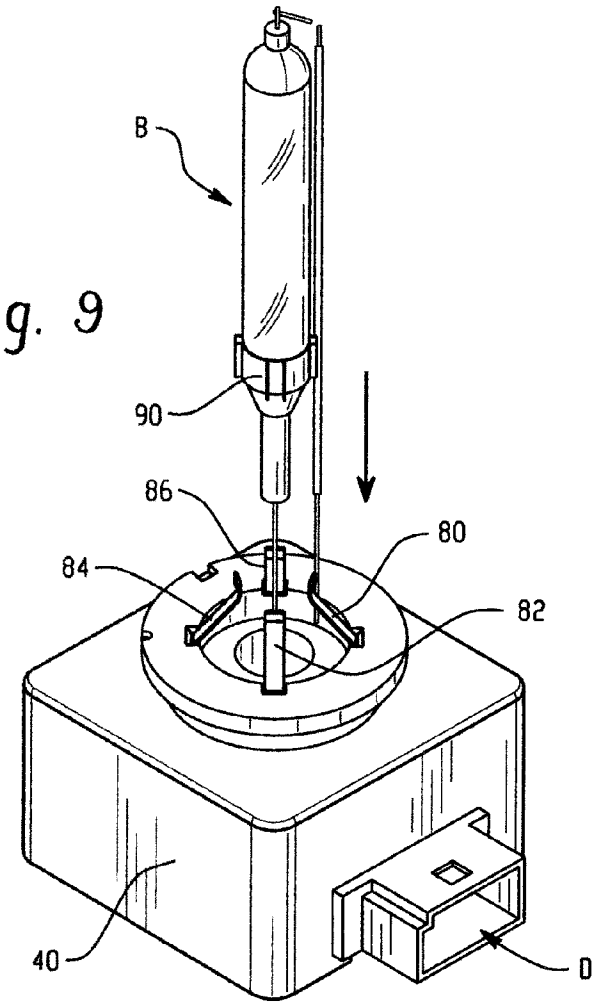
FIG. 9 shows an upper surface of the housing once the printed circuit board has been installed, and illustrates assembly of the light source to the housing.

FIG. 9 shows the burner assembly housing from the upper surface. The burner assembly includes mounting and support straps, preferably conductive spring clips 80, 82, 84, 86, that resiliently engage strap 90 received about a lower end of the lamp envelope. Once the light source B is fully installed so that the respective lamp leads are received through openings in the housing and through the printed circuit board, the lamp leads are secured or welded to the desired locations on the printed circuit board as represented in FIG. 10.

Figure 11:
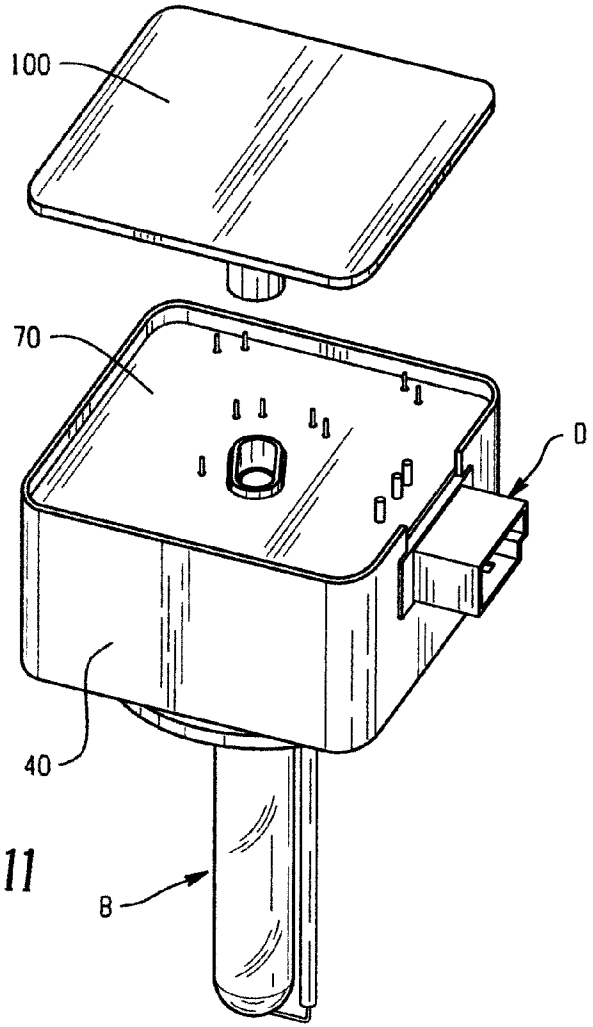
FIG. 11 shows installation of a bottom plate over an underside of the housing.

As illustrated in FIG. 11, a bottom plate 100 is suitably dimensioned to fit over the printed circuit board and within the perimeter of the housing 40. The perimeter edge is sealingly secured to the housing through an ultrasonic welding operation or a fusion bonding.

Figure 12:
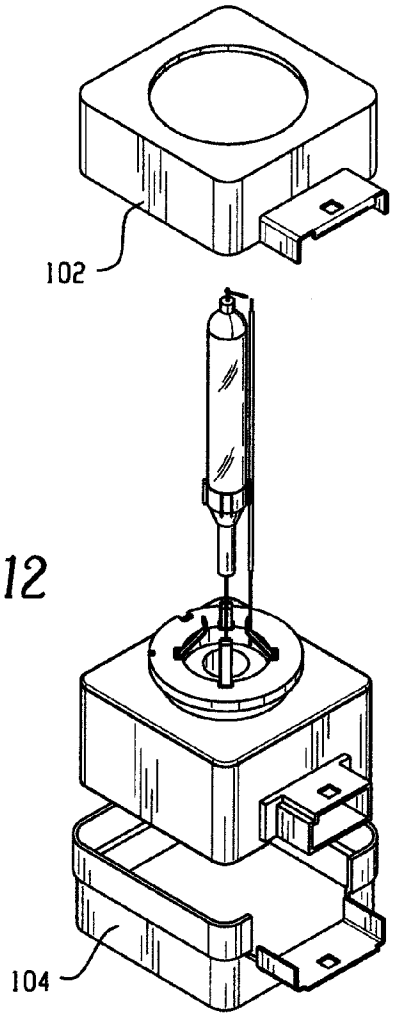
FIG. 12 demonstrates assembly of first and second shield portions over the burner assembly and light source.

In FIG. 12, an electromagnetic interference shielding is added to the headlamp assembly. In the illustrated embodiment, the shielding is a two-part electrically conductive body such as first and second shielding portions 102, 104 that are received over the housing of the burner assembly.

Figure 14:
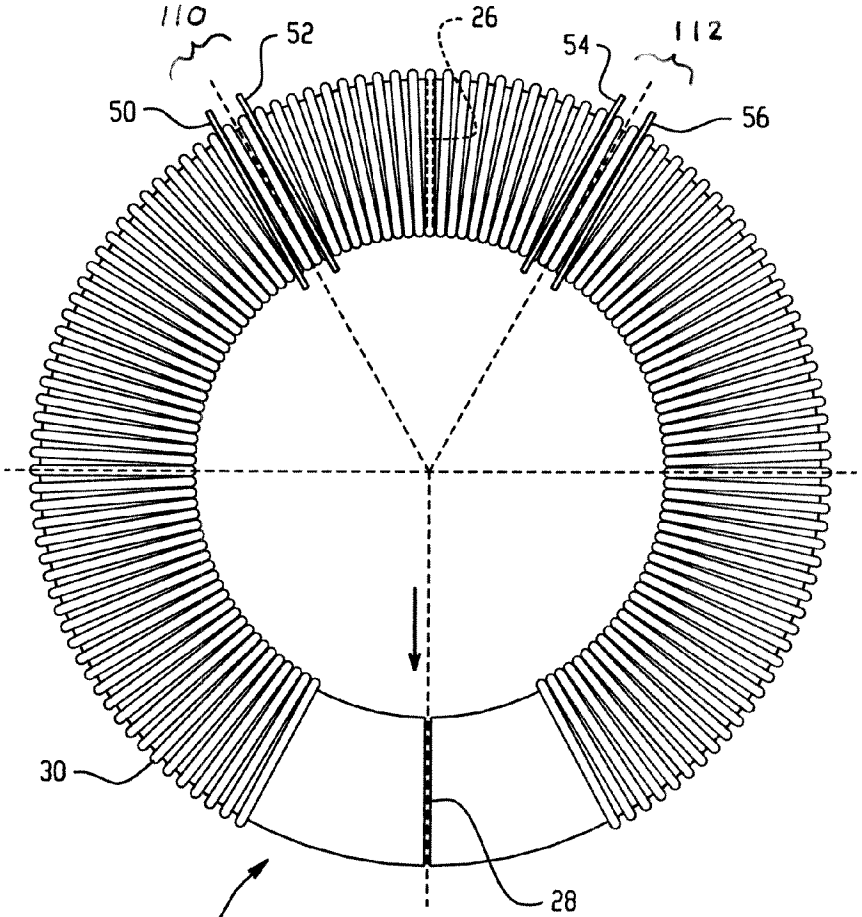
FIG. 14 is a plan view of the core, secondary winding, and first and second primary windings.
Figure 13:
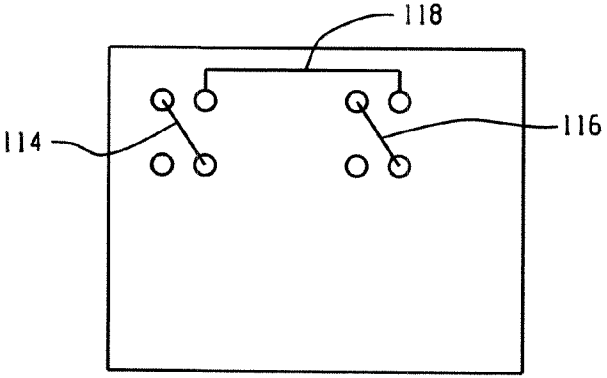
FIG. 13 is a plan view of traces provided on the printed circuit board forming a portion of the primary winding turns.

As described above with respect to FIGS. 6-8 and 10, the printed circuit board includes conductive traces as represented in FIG. 13 for completing the turns of the primary windings. That is, first and second primary windings are represented in FIG. 14 at spaced locations from the first gap 26 of the core, and are provided around the core and secondary windings at these locations. Preferably, the primary windings 110, 112 are symmetrically arranged relative to the first gap 26, for example at an angular orientation 30 degrees offset to either side of the first gap. Again, and without limiting the present disclosure, each of the first and second primary windings has two turns. Conductive members 50, 52 in conjunction with first trace 114 (FIG. 13) on the printed circuit board define, at least in part, the first and second turns associated with the first primary winding 110. More particularly, conductive member ends 50*a*, 50*b*, 52*a*, 52*b* electrically connect with traces on the printed circuit board. Moreover, one pin from each conductive member of a pair is electrically connected with another pin through another trace to define the continuous winding of the primary winding. A similar arrangement is provided for the second primary winding. For example, terminal ends 50*a*, 50*b* are interconnected through the remainder of conductive member 50, while terminal ends 50*a*, 52*b* are connected through trace 114 on the printed circuit board. Likewise, ends 54*a*, 54*b* are connected through the conductive member 54 encased in the plastic housing, while ends 54*a*, 56*b* are interconnected through trace 116 on the printed circuit board. In this manner, the first and second primary windings are received about minor portions of the first and second core member portions, respectively, and the two turns of each primary winding only surround a minor portion of the secondary winding.

Further, the primary windings are preferably symmetrically spaced from each of the gaps 26, 28 of the split core. The primary windings are formed at least in part by one or more of conductive members 50, 52, 54, 56 and further formed at least in part by trace 114, 116, provided on the printed circuit board. Although the conductive members in the present disclosure form at least in part the primary windings, one skilled in the art will appreciate that similar conductive members encapsulated in the housing could be used as part of a secondary winding arrangement without departing from other aspects of the present disclosure.

As noted above, the core and secondary winding are preferably preassembled as a subassembly prior to installation in the housing cavity as shown in FIG. 3. Alignment of the second gap 28 with the indicia in the housing cavity provides precise orientation of the core and secondary winding. Moreover, since the conductive members have predetermined locations because they are molded within the housing, this also fixes in a precise manner the dimensional orientation of the primary and secondary windings relative to one another. The traces on the printed circuit board are thus aligned to complete the primary windings once the board is installed on the housing (FIGS. 7 and 8). Thus, the primary windings are electrically coupled to the secondary winding and step up the voltage to a predetermined level (e.g., 25 kV, or other desired level).

Although in the preferred arrangement the secondary windings are symmetrically arranged relative to the first and second gaps, and likewise the primary windings are shown as being symmetrically arranged relative to the gaps, this need not necessarily be the case. Further, the first and second primary windings are connected in parallel by additional traces in the printed circuit board, represented as 118 for example, in FIG. 13.

This assembly and preferred method of assembly improves the coupling effect of a high voltage split core transformer, thereby allowing a reduction in the number of turns of the secondary winding and allowing the use of larger cross-sectional wire which increases the current carrying capability. As a result, the transformer is suitable for use in D1-D5 automotive headlamp applications. The assembly method also simplifies the manufacture of the transformer assembly and reduces variation in the coupling factor from one headlamp assembly to another because of the precise orientation of the headlamp components. This improves the performance of the transformer.

In summary, this disclosure describes a gas discharge or high intensity discharge lamp base with a housing comprising an upper part and a cover. Electronic components used to ignite the gas discharge lamp are mounted and electrically connected to a printed circuit board. The igniter uses a split toroidal transformer to help accommodate the gas discharge lamp that is mounted to an upper section of the housing. The toroidal transformer has two symmetrically distributed gaps and a secondary winding covering only one of the gaps. The secondary winding is connected in series with the lamp.

The transformer also has two primary windings including two turns each and connected in parallel. The primary windings are arranged such that one winding is placed over each half of the split toroid. By placing one primary winding over each half of the split toroid, the coupling effect between primary and secondary windings is improved allowing the number of turns of the secondary winding to be reduced. By reducing the number of turns on the secondary winding, a larger cross-sectional area of wire can be used to accommodate the increased current carry requirement of a D5-type automotive headlamp system, making the same design suitable for D1-D5 automotive headlamp applications.

The location of the primary windings over the secondary winding is important for the performance of the transformer. The simplified method of construction of the transformer controls the variation of the coupling. The four U-shaped pins or brackets are molded into the lamp housing. The pins form a portion of the primary windings. The toroidal transformer with the secondary winding is placed into the lamp base over the U-shaped brackets and potted. The PC board containing the electrical components is placed over the transformer with the U-shaped pins protruding through the board and soldered (or welded) in place. Conductive traces on the board then complete the primary windings and connect the two windings in parallel.

The invention has been described with respect to preferred embodiments. Alterations and modifications, such as changing the number of turns or changing the shape of the housing, or using regular wire for the primary instead of pins and a PC board all fall within various aspects of the present disclosure. The disclosure should not be limited by such changes but rather only limited by the accompanying claims.

What is claimed is:

1. A transformer assembly having an improved coupling factor comprising:

a split core having first and second core members separated by first and second spaced gaps;

a secondary winding received over the first and second core members and covering the first gap, and first and second ends of the secondary winding terminating at symmetrically spaced locations from the second gap;

a primary winding received around at least a portion of the secondary winding;

a housing receiving the split core therein, at least a portion of one of the windings formed by a conductive member encased in the housing, wherein the conductive member includes a generally U-shaped member forming a portion of a turn of the one of the primary and secondary windings; and a printed circuit board having a conductive trace that electrically connects with the conductive member to form at least a portion of one of the windings.

2. The assembly of claim 1 wherein the first and second ends of the secondary winding are symmetrically spaced from the second gap.

3. The assembly of claim 1 further comprising means for aligning the core relative to the housing.

4. The assembly of claim 3 wherein the aligning means includes indicia on the housing for aligning the second gap relative to the indicia.

5. The assembly of claim 1 further comprising first and second pins located in the housing at predetermined locations for attachment with first and second ends of the secondary winding.

6. The assembly of claim 1 wherein the generally conductive member includes first and second conductive members at predetermined locations in the housing for forming portions of first and second primary windings symmetrically located relative to the first gap.

7. The assembly of claim 6 wherein the first and second conductive members are encased in the housing except for opposite ends thereof.

8. The assembly of claim 7 wherein the opposite ends of the first and second conductive members electrically contact the first and second conductive traces, respectively.

9. The assembly of claim 1 wherein the primary winding includes first and second separate primary windings.

10. The assembly of claim 9 wherein the first and second primary windings are symmetrically spaced from the first gap.

11. The assembly of claim 9 wherein the first and second primary windings each have no more than two turns.

12. A method of assembling an igniter for an associated automotive discharge lamp such that a coupling factor thereof is improved, the method comprising:

providing a split core having first and second core portions spaced by symmetrically spaced first and second gaps, and a secondary winding extending around the first gap and with first and second ends of the secondary winding located at positions spaced from the second gap;

positioning the split core with secondary winding at a predetermined orientation relative to a housing dimensioned to receive the split core; and providing first and second primary windings around the secondary winding such that the first primary winding is placed over the first core portion and the second primary winding is placed over the second core portion, wherein the step of providing first and second primary windings includes incorporating at least first and second generally U-shaped conductive members in the housing to form at least a portion of the first and second primary windings, respectively.

13. The method of claim 12 further comprising connecting the first and second primary windings in parallel.

14. The method of claim 12 wherein the first and second primary windings are symmetrically located relative to the gaps.

15. The method of claim 12 wherein the step of providing first and second primary windings includes incorporating a printed circuit board having at least first and second traces that form at least a portion of the first and second primary windings, respectively.

16. The method of claim 12 wherein the step of providing first and second primary windings includes incorporating generally U-shaped conductive members in the housing to form portions of first and second turns of each of the first and second primary windings, respectively.

17. The method of claim 12 wherein the step of providing first and second primary windings includes incorporating a printed circuit board having at least first and second traces that form at least a portion of the first and second primary windings, respectively.

18. The method of claim 12 of aligning the second gap of the core with indicia on the housing.

19. The method of claim 12 wherein opposite ends of the secondary winding are electrically connected to associated lamp leads, and wherein the first and second primary windings are connected in parallel and inductively coupled with the secondary winding.

* * * * *